United States Patent [19]

Dahlberg

[11] Patent Number: 4,712,181

[45] Date of Patent: Dec. 8, 1987

[54] METHOD OF COMBATING DIFFERENT TYPES OF AIR TARGETS

[75] Inventor: Kurt Dahlberg, Karlskoga, Sweden

[73] Assignee: Aktiebolaget Bofors, Bofors, Sweden

[21] Appl. No.: 772,520

[22] Filed: Sep. 4, 1985

[30] Foreign Application Priority Data

Sep. 4, 1984 [SE] Sweden ..... 8404403

[51] Int. Cl.[4] ..... G06F 15/48

[52] U.S. Cl. ..... 364/423; 89/41.22; 89/41.16

[58] Field of Search ..... 364/423; 89/41.13, 41.16, 89/41.22

[56] References Cited

U.S. PATENT DOCUMENTS 3,897,714 8/1975 Perrin ..... 89/41.16
3,974,740 8/1976 Billottet ..... 89/41 SW
4,114,510 9/1978 Prince ..... 89/1.41
4,449,041 5/1984 Girad ..... 364/423
4,464,975 8/1984 Terry ..... 89/41.13

FOREIGN PATENT DOCUMENTS 1164107 9/1969 United Kingdom .

*Primary Examiner*—Jerry Smith
*Assistant Examiner*—Gail Hayes
*Attorney, Agent, or Firm*—Pollock, Vande Sande & Priddy

[57] ABSTRACT

A method is provided for optimizing target coverage or a computer-controlled automatic gun anti-aircraft defence system equipped with proximity fuse activated explosive shells which, are programmed by the computer to fire rounds of a predetermined number of shells and re-lay the gun between each shell so that the shells at a calculated firing range form a hit pattern covering the entire target, selected in view of a performed target identification.

5 Claims, 4 Drawing Figures

METHOD OF COMBATING DIFFERENT TYPES OF AIR TARGETS

BACKGROUND OF THE INVENTION

The present invention relates to a method of optimizing target coverage for a computer-controlled automatic gun anti-aircraft defense weapon equipped with proximity fuze activated explosive shells.

The capability of modern anti-aircraft defense systems to combat difficult air targets such as aircraft and missiles has indeed been increased through the availability of high-class reconnaissance and fire control radar, laser rangefinders and rapid computers combined with quick-firing fully automatic anti-aircraft guns equipped with proximity fuzed shells. However, at the same time, the targets have become more difficult to combat, and completely new and extremely difficult to combat types of targets such as the so-called seaskimmers and cruise missiles have appeared on the scene. A common feature of most modern anti-aircraft target types, regardless of whether they consist of aircraft, helicopters or missiles, is also that they operate tactically in such a manner that the anti-aircraft defence weapon has very little time for target detection, target range measurement, calculations, gun aiming and firing. It is therefore essential for the anti-aircraft gun to rapidly engage and to cover the target with effective fire. Despite the available material, ever greater technical requirements and consequent higher competence, the risk nevertheless always remains that minor errors in target range measurement and calculations and unpredictable manoeuvres by the targets such as tactically unjustified changes in course and rapid changes in speed and/or atmospheric fluctuations can result in misfires. The greatest chance of effect in the target is therefore obtained if one directly covers the point and area around which it is calculated that the target will be when the projectiles reach their destination with several shells whose coverage range has its focal point in the previously mentioned point where the target is calculated to be. A certain well-defined dispersion of the various shells in one and the same round is therefore desirable. Although it is true that each weapon gives rise to a certain dispersion between the hit points for several succeeding shells experience has nevertheless shown that this dispersion is too limited to give the desired result when it comes to combating contemporary air targets. Naturally it is also undesirable to reduce the accuracy of the anti-aircraft guns because this would reduce possibilities of actually hitting the point where the target is estimated to be at a specific point of time.

It has previously been proposed that a specific pattern of hits around the estimated position of the target shall be forced about through minor angular corrections for the gun between the individual shells in a round. This can take place, for example, by moving the gun around the point of aim during firing. This method was often practiced, for example, with older types of manually laid machine gun and light automatic gun anti-aircraft defense with simple laying means. Naturally the method can also be used for a predetermined automatic displacement of an anti-aircraft gun during firing. The same result can also be achieved by building in some displacement into the gun between the hit points of the individual shells and the calculated aiming point of the gun. This method has been tested, for instance, on today's multi-barrel gatling guns. These guns are equipped with a plurality of barrels which are rotated around a shaft disposed in the firing direction of the gun, and the different barrels are fired consecutively upon reaching a specific firing position while the other part of the revolution around the shaft is exploited to remove the empty cartridge cases and to reload the different barrels. In these gatling guns, the desired dispersion has been achieved by setting certain barrels at a slant relative to the shaft of the gun.

Both the latter method according to which the different barrels fire around the aiming point in accordance with a certain schedule and the previously mentioned method according to which the gun moves in accordance with a predetermined program during firing give rise, however, to purely angle-dependent hit patterns where the dispersion between the individual shells is completely dependent on the distance to the target. With these methods, then, the optimized hit pattern can only be achieved at a single normal firing range.

SUMMARY OF THE PRESENT INVENTION

The present invention relates to a method of optimizing target coverage for such computer-controlled automatic gun anti-aircraft defense weapons that are equipped with proximity fuze activated explosive shells and in which the computer controlling the laying of the gun and its laying system has sufficient capacity to relay the gun between each shell. The implication is thus that the rate of fire of the gun must not be all too high since the present invention is based on an individual aiming of each shell in a round so that a predetermined hit pattern is obtained at the calculated target range. With present-day technology rates of fire of up to 500–700 rounds/minute should nevertheless give rise to any problems, whereas firing with high-speed guns which fire several thousand shells per minute cannot be controlled in the manner that characterizes this invention.

According to the present invention the hit pattern is selected on the basis of a completed target identification and with due allowance for the altitude of the target. The number of shells per round can be determined either once and for all or be adapted to the performed target identification and then selected hit pattern. With regard to the hit patterns it also applies that the activation areas of the proximity fuzes for adjacent shells in the round shall partly cover each other and at the same time the activation areas of the proximity fuzes shall not go so close to the ground plane that the target can impossibly go so low. In the case of low-flying targets, this gives hit patterns which are planed off downwardly towards the ground plane at the same time as the hit pattern, with a small number of shells, can be built up in height in that the proximity fuzes there get a larger sensitivity range. This is of great value since a very low flying target can only take evasive action by moving upwards, downwards or sideways. Moreover, the hit pattern in conjunction with the target identifications can be adapted so, that several shells are disposed close to the calculated position of the target when the target is large and hard and easier to measure in, than when the target is small and difficult to measure in, and possibly moves so close to the ground plane that the sensitivity area of the proximity fuzes becomes clearly restricted, and therefore more adjacent shells are required to form a hit pattern with sufficient side coverage.

The main inventive concept, then, is that a hit pattern around the target adapted in view of type of target and target altitude will always be obtained, in which the distance between the individual shells in the round is always the same calculated in meters regardless of the firing range but, in contrast, always dependent upon the hit pattern selected on the basis of the performed target identification.

The method according to the invention has been defined in the accompanying patent claims and will now be further described in conjunction with some examples of hit patterns according to the invention.

The technical implementation of the method according to the present invention, in contrast, is not described in detail in the present context since it involves pure programming of the computer that controls the aiming and firing of the gun. This programming is performed in accordance with known guidelines. The computer and the unit interconnected with this and with the gun is also of a known type and therefore will not be discussed more closely in the text.

The present invention will now be described with reference being made to the drawings in which:

DESCRIPTION OF THE PREFERRED EMBODIMENT

FIGS. 1-4 show optimal hit patterns at calculated firing ranges for different target types. Generally applicable to each figure is that each X marks the hit point for individual shells while the circle concentrically disposed around each such X indicates the activation area for the proximity fuze of the respective shell. The scales inserted on each figure indicate the distance in meters. The zero-points of the scales indicate the point at which all measurements and calculations have indicated that the target should be when the round of shells reaches it.

Figure 1:
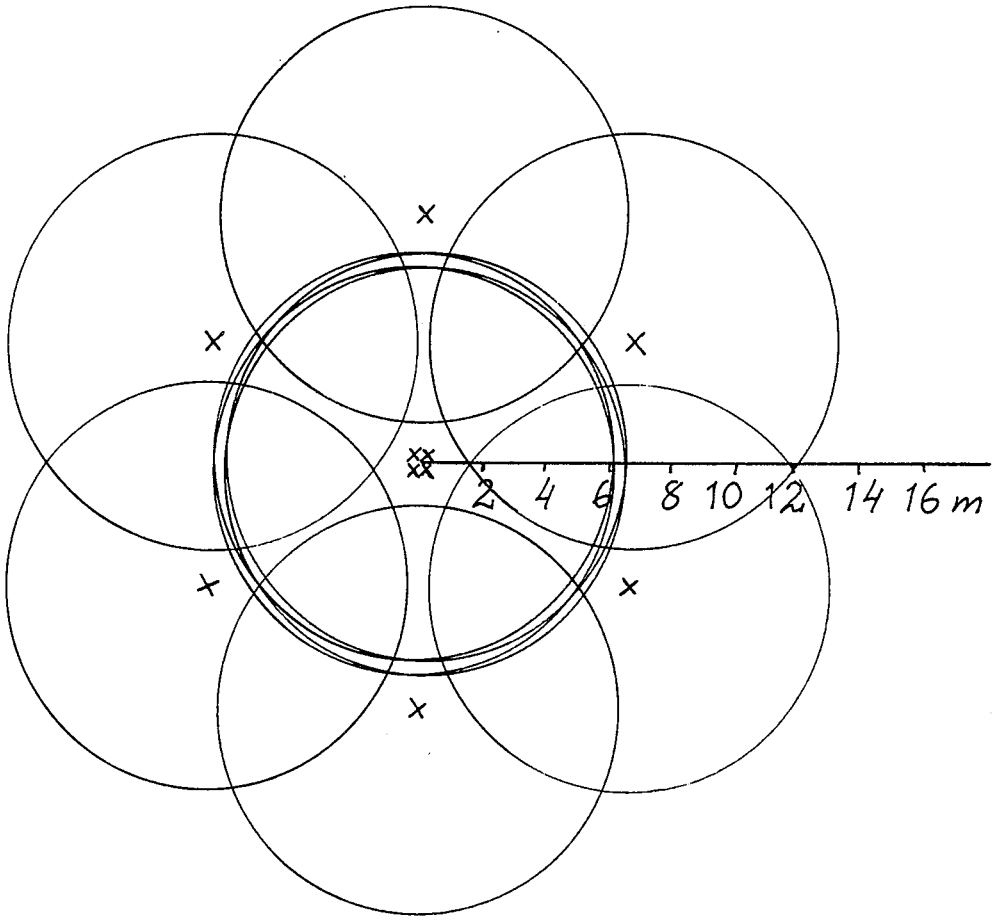
FIG. 1 shows an optimal hit pattern according to the present invention for an aircraft target.

FIG. 1 shows the optimal hit pattern according to the invention when the target consists of an aircraft. This target type is relatively large and can therefore be measured in with good accuracy but it can be calculated to be a hard target and for this reason four shells have been aimed at or very close to its calculated position while the other six shells in the round of ten shells have been distributed around the four centered shells. The distribution of the latter six shells has been done uniformly all round in such a manner that the activation area for the proximity fuzes for the shells adjacent to one another partly cover each other. This latter condition also applies to the different shells in the other figures.

Figure 2:
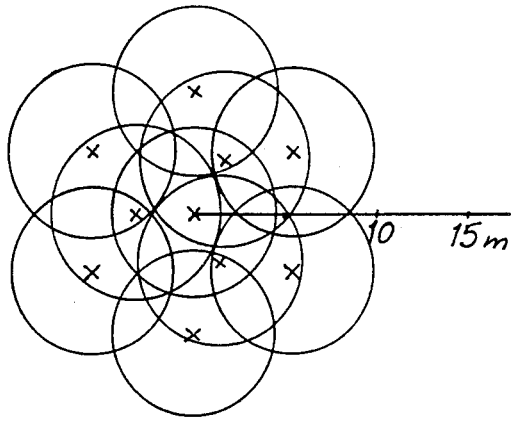
FIG. 2 shows an optimal hit pattern for a high altitude missile.

FIG. 2 shows the optimal hit pattern for a missile at high altitude. The target in this case is smaller but it can also be calculated to be less "hard" than the aircraft. For this reason one shell has been aimed directly at the point where the target is calculated to be when the shells reach it and three shells uniformly distributed around this point as an inner circle, and additionally an outer circle of six shells.

Figure 3:
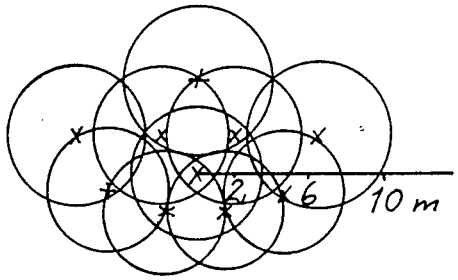
FIGS. 3 and 4 show optimal hit patterns for seaskimmers at altitudes of 5 and 10 meters, respectively.
Figure 4:
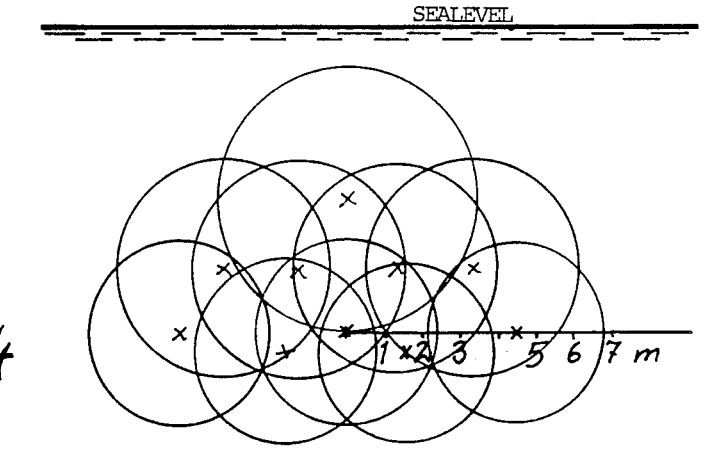

FIGS. 3 and 4 show optimal hit patterns against so-called seaskimmers at altitudes of 5 meters and 10 meters respectively above the water. The lowest altitude of the seaskimmer is dependent upon the wave height. The implication is that it cannot go all too low as it would then enter the sea. The hit pattern can therefore be flattened off downwards whereas upwards advantage is taken of the greater activation area of the proximity fuzes at a somewhat higher altitude. Otherwise, these figures also show the positions of the individual shells in a round of 10 shells. Naturally, rounds of more or less than 10 shells can be distributed in the manner characteristic of the invention.

I claim:

1. A method of optimizing target coverage for a computer-controlled automatic gun anti-aircraft defense system equipped with proximity fuze activated explosive shells, comprising the steps of:

programming a computer which controls the laying and firing of the gun to distribute upon firing the predetermined number of shells included in each round shell by shell, so that these form at a calculated firing range a predetermined hit pattern with its focal point in the calculated position of the target and in which the distance in meters between the individual shells in the round on the calculated firing range is always the same regardless of the calculated distance to the target, and the activation range for the proximity fuze of each shell partly overlaps the activation range for the proximity fuzes for adjacent shells in the hit pattern; and, selecting said hit pattern and the position for each individual shell therein upon determination of a performed target identification and the calculated altitude of the target.

2. A method according to claim 1, wherein the hit pattern for a low-flying target is adapted to the lowest theoretical altitude for said target by placement of no shell lower than the lowest theoretical altitude of said target.

3. A method according to claim 2, wherein the hit pattern includes allowance for the even greater activation area of the proximity fuzes at higher altitudes above the ground level.

4. A method according to claim 1 or 2, further comprising a step of modifying the hit pattern by placing several shells close to the calculated position of the target, upon identification of large and hard targets.

5. A method according to claim 4, wherein four out of ten shells are placed very close to the calculated position of the target while six are distributed around, so that the activation areas for the sensitivity of adjacent shells partially cover each other.

* * * * *